US009526364B1

(12) United States Patent
Lovison

(10) Patent No.: US 9,526,364 B1
(45) Date of Patent: Dec. 27, 2016

(54) PORTABLE BEVERAGE APPARATUS

(71) Applicant: Direct Marketing Group, Eden Prairie, MN (US)

(72) Inventor: Douglas Lovison, Miami, FL (US)

( * ) Notice: Subject to any disclaimer, the term of this patent is extended or adjusted under 35 U.S.C. 154(b) by 0 days.

(21) Appl. No.: 14/217,885

(22) Filed: Mar. 18, 2014

(51) Int. Cl.
*B65D 6/40* (2006.01)
*A47G 23/02* (2006.01)
*B65D 81/38* (2006.01)

(52) U.S. Cl.
CPC ..... *A47G 23/0216* (2013.01); *A45C 2200/20* (2013.01); *A45F 2200/0583* (2013.01); *B65D 81/3876* (2013.01)

(58) Field of Classification Search
CPC ..... B65D 81/3876; A45C 2200/20; A45F 2200/0583; A47G 23/0216
USPC ..... 220/737
See application file for complete search history.

(56) References Cited

U.S. PATENT DOCUMENTS 3,751,319 A 8/1973 Green et al.
4,105,806 A 8/1978 Watt
4,597,210 A 7/1986 Kitrell
4,841,903 A 6/1989 Bird
4,933,218 A 6/1990 Longobardi
4,971,646 A 11/1990 Schell et al.
4,978,593 A 12/1990 Yin et al.
5,082,703 A 1/1992 Longobardi
5,132,148 A 7/1992 Reafler
5,169,025 A * 12/1992 Guo ..... 220/739
5,223,357 A 6/1993 Lovison
D376,957 S * 12/1996 Sharp ..... D7/607
5,968,607 A 10/1999 Lovison
6,237,820 B1 * 5/2001 Saxton ..... 224/148.5
6,708,838 B2 * 3/2004 Bergman et al. ..... 220/757
7,403,309 B2 7/2008 Moncrieff
7,858,015 B2 * 12/2010 Urquhart ..... B65D 81/3876 162/218
9,044,113 B2 * 6/2015 Hargett
2005/0230467 A1 * 10/2005 Prescott ..... 229/403
2013/0020223 A1 * 1/2013 White ..... 206/459.5

* cited by examiner

*Primary Examiner* — Shawn M Braden
(74) *Attorney, Agent, or Firm* — Crawford Maunu PLLC

(57) ABSTRACT

Aspects of the present disclosure are directed toward a substrate that flexes from a planar state to a cylindrical state. The substrate is held in the cylindrical state by at least one closure mechanism that includes a plurality of engageable portions and a plurality of insertable portions. The plurality of insertable portions are inserted into the plurality of engageable portions to engage the at least one closure mechanism, and to mitigate withdrawal of the plurality of insertable portions from the plurality of engageable portions.

19 Claims, 6 Drawing Sheets

PORTABLE BEVERAGE APPARATUS

OVERVIEW

Thermal insulating sleeves are available for insulating beverages and beverages containers (e.g., cans, bottles, or other liquid containers) that not only provide insulative properties, but also provide a platform for display of various images for advertising, slogans, or other types of images. Thus, it is desirable to provide a thermal insulating sleeve that is not only insulative, but prominently displays various images thereon.

Additionally, the insulating sleeves are typically mass produced at a location, and shipped across the country and/or the world. In this manner, shipping costs could be greatly reduced if the insulating sleeves were shipped flat, and assembled at the final shipping destination.

SUMMARY

Various example embodiments are directed to portable beverage containers that are insulative, inexpensive, and display visual effects. The portable beverage containers include a construction that allows for the containers to be shipped in a flat or planar state, and is simple enough for an end consumer to form the apparatus into its final cylindrical shape.

Accordingly, various aspects of the instant disclosure are directed toward apparatuses that utilize a substrate and at least one closure mechanism, and methods of using such apparatuses. In certain embodiments, the substrate, having an interior side and an exterior side, includes an adhesive layer, a metallization layer provided on the adhesive layer, a printing layer of textured graphics arranged on the metallization layer, and a clear and flexible plastic layer that provides a planar surface over the printing layer. Additionally, the substrate can flex between a planar state, and a cylindrical state in which the interior surface and the exterior surface form concentric cylinders. Apparatuses and methods also include a first closure mechanism and a second closure mechanism, both of which include a plurality of engageable portions and a plurality of insertable portions. The two closure mechanisms hold the substrate in the cylindrical state by insertion of the first set and second set of the plurality of insertable portions within the first set and the second set of the plurality of engageable portions. The insertion engages the first closure mechanism and the second closure mechanism, and mitigates withdrawal of the plurality of insertable portions from the plurality of engageable portions.

Aspects of the present disclosure are also directed toward apparatuses and methods that include a substrate that flexes from a planar state, in which an interior side and an exterior side of the substrate are opposing and substantially parallel with respect to one another, to a cylindrical state in which the interior surface and the exterior surface form concentric cylinders. Additionally, at least one closure mechanism is provided to hold the substrate in the cylindrical state. The closure mechanism includes a plurality of engageable portions and a plurality of insertable portions. Upon insertion of the plurality of insertable portions within the plurality of engageable portions, the closure mechanism becomes engaged, and mitigates withdrawal of the plurality of insertable portions from the plurality of engageable portions.

The above discussion is not intended to describe each embodiment or every implementation. The figures and following description also exemplify various embodiments.

BRIEF DESCRIPTION OF THE FIGURES

Various example embodiments may be more completely understood in consideration of the following detailed description in connection with the accompanying drawings, in which.

Figure 1:
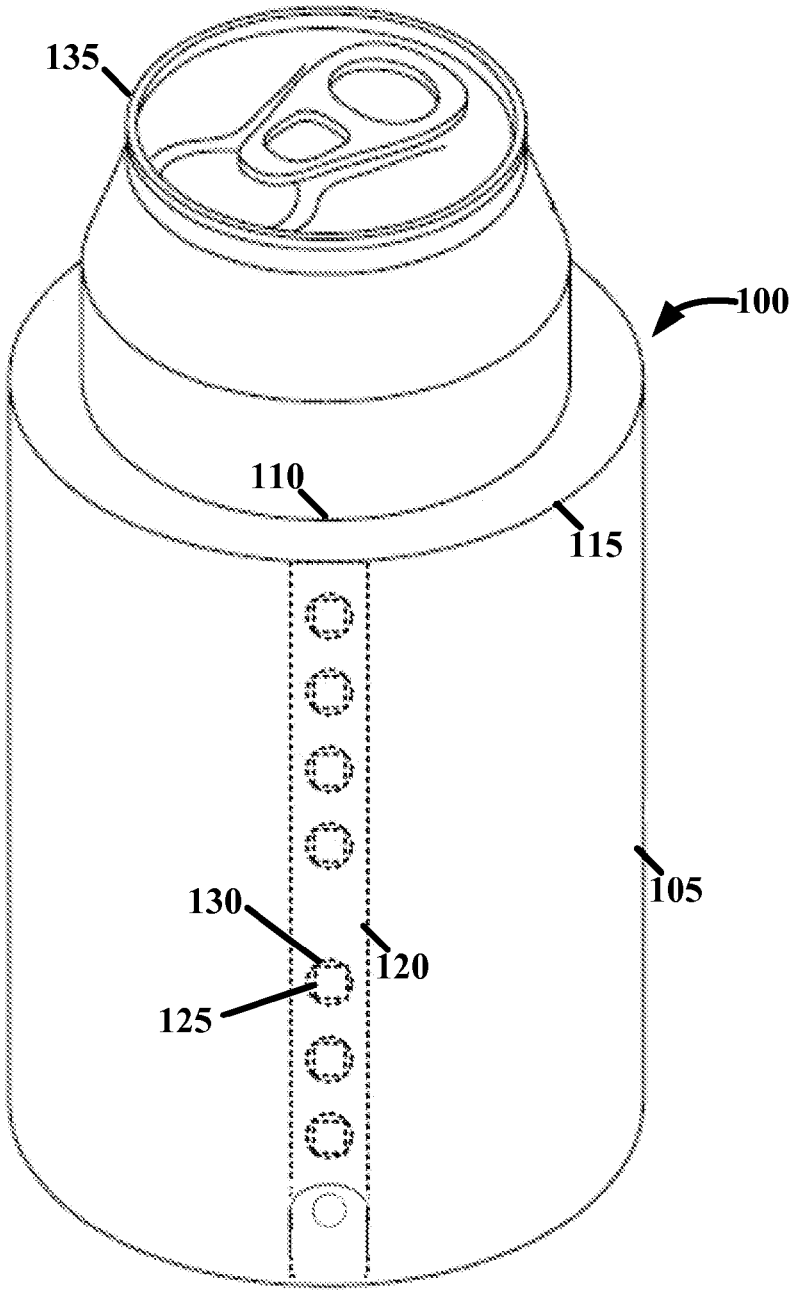
FIG. 1 shows an example portable beverage apparatus, consistent with various aspects of the present disclosure.

While the disclosure is amenable to various modifications and alternative forms, examples thereof have been shown by way of example in the drawings and will be described in detail. It should be understood, however, that the intention is not to limit the disclosure to the particular embodiments shown and/or described. On the contrary, the intention is to cover all modifications, equivalents, and alternatives falling within the spirit and scope of the disclosure.

DETAILED DESCRIPTION

The present disclosure is believed to be applicable to a variety of different types of apparatuses and methods involving portable beverage containers. While the present invention is not necessarily so limited, various aspects of the invention may be appreciated through a discussion of examples using this context.

Embodiments of the present disclosure are directed to apparatuses having a substrate that includes an adhesive layer, a metallization layer provided on the adhesive layer, and a printing layer of textured graphics on the metallization layer. Further, a clear and flexible plastic layer is layered on the printing layer and provides a planar surface to an exterior side of the substrate. The substrate can flex between a planar state and a cylindrical state. The planar state of the substrate is characterized in that the exterior side and the interior side are opposing and substantially parallel with respect to one another. For example, when the substrate is lying flat on a surface, the exterior side and the interior side are opposite one another, and the substrate itself is substantially parallel with that surface. The cylindrical state of the substrate is characterized in that the interior surface and the exterior surface form concentric cylinders. In this manner, if the substrate is provided on a surface, the substrate can stand vertically on the surface in its cylindrical state.

Apparatuses, consistent with various aspects of the present disclosure, also include at least one closure mechanism. In certain embodiments, an apparatus can be provided with a single closure mechanism, a first closure mechanism and a second closure mechanism, or more closure mechanisms as needed. Each of the closure mechanisms includes a first set of a plurality of engageable portions and a plurality of insertable portions. In embodiments of the present disclosure including a first and second closure mechanism, the mechanisms hold the substrate in the cylindrical state by insertion of the first set and second set of the plurality of insertable portions within the first set and the second set of the plurality of engageable portions. The insertion engages the insertable portions of first closure mechanism with the engageable portions of the first closure mechanism. Further, the insertion also engages the insertable portions of the second closure mechanism with the engageable portions of the second closure mechanism. The insertion of these portions mitigates withdrawal of the plurality of insertable portions from the plurality of engageable portions.

In certain more specific embodiments of the present disclosure, the plurality of insertable portions include two extension members extending perpendicular from the substrate. The two members include at least one barb extending away from the extension members. Additionally, the plurality of engageable portions are cylindrical and include a first end portion that facilitates insertion of the plurality of insertable portions, and locking portion that engages the at least one barb to prevent withdrawal of the plurality of insertable portions from the plurality of engageable portions.

Additionally, in certain embodiments, the substrate, in the planar state, includes a first end portion and a second end portion that are at laterally opposing ends of the interior side and the exterior side. Further, the substrate, when in the cylindrical state, includes a first end portion arranged adjacent to the second end portion to form the concentric cylinders. Other embodiments of the present disclosure include a substrate, in a cylindrical state, including the first closure mechanism arranged on a plane the same as that of the second closure mechanism. In other embodiments, substrates used in apparatuses of the present disclosure include at least one layer composed of neoprene, foam, polyester, cotton, wool, or a combination thereof. Further, the substrate, in the concentric state, can form a receptacle for an object. In this configuration, the substrate provides insulation to mitigate heat transfer of the object such as a beverage container, a can, or a bottle.

Various embodiments of apparatuses including a substrate have a metallization layer that enhances a visual effect of a printing layer by acting as a reflector of light. The visual enhancement occurs based on light passing through the transparent segments of the printing layer, and the printing layer including varying degrees of thicknesses to provide the three-dimensional graphics visualization. In other embodiments, the printing layer is provided at a thickness of up to 3 millimeters thick or greater (up to 6 millimeters).

In certain embodiments, a closure mechanism, operable to hold the substrate in the cylindrical state, is composed of at least one of, or a combination of, plastic, metal, and rubber. Further, in other embodiments, a closure mechanism(s) holds the substrate in the cylindrical state based on the insertable portions of the closure mechanism(s) inserting into the engageable portions of the closure mechanism(s) through openings in the substrate.

Various aspects of the present disclosure are also directed toward apparatus having a substrate that flexes from a planar state to a cylindrical state. In the planar state, the substrate is substantially parallel with respect its interior and exterior sides. In the cylindrical state, the substrate forms a cylinder that is based on the interior and exterior sides forming concentric cylinders. The apparatus includes at least one closure mechanism including a plurality of engageable portions and a plurality of insertable portions. The closure mechanism holds the substrate in the cylindrical state by insertion of the plurality of insertable portions within the plurality of engageable portions to engage the closure mechanism. This mitigates withdrawal of the plurality of insertable portions from the plurality of engageable portions. In certain embodiments, the substrate is further characterized as having an adhesive layer, a metallization layer and a printing layer. The metallization layer is provided on the adhesive layer, and the printing layer is arranged on the metallization layer to provide textured graphics. Further, a clear and flexible plastic layer is arranged on/over the printing layer to provide a planar surface of the substrate.

Various aspects of the present disclosure are also directed toward methods of using and/or manufacturing the apparatus of the present disclosure. For instance, a substrate is provided that includes an interior side and an exterior side. The exterior side of the substrate includes an adhesive layer, a metallization layer provided on the adhesive layer, a printing layer of textured graphics arranged on the metallization layer, and a clear and flexible plastic layer that provides a planar surface over the printing layer. Further, the substrate can flex from a planar state to a cylindrical state in which the interior surface and the exterior surface form concentric cylinders. Also included in the methods, consistent with the instant disclosure, are a first closure mechanism, including a first set of a plurality of engageable portions and a plurality of insertable portions; and a second closure mechanism, including a second set of a plurality of engageable portions and a plurality of insertable portions. The first set and the second set of the plurality of insertable portions are inserted within the first set and the second set of the plurality of engageable portions, to engage the first closure mechanism and the second closure mechanism in order to mitigate withdrawal of the plurality of insertable portions from the plurality of engageable portions and to hold the substrate in the cylindrical state.

In certain embodiments, methods of the present disclosure include printing the printing layer on the substrate by utilizing at least one of silk screening, litho-printing, flexo-printing, die sublimation transfer, or digital printing. Additionally, printing the printing layer can include utilizing an ink composition of at least one of ultraviolent (UV) inks, oxidizing inks or paints, or toner inks. Further, the substrate can be provided by die cutting, laser cutting, or plotter cutting.

Turning now to the figures, FIG. 1 shows an example portable beverage apparatus, consistent with various aspects of the present disclosure. The portable beverage apparatus 100 includes a substrate 105, and is shown in a cylindrical state as is formed by interior 110 and exterior 115 sides of the substrate 105 that form concentric cylinders. In a non-cylindrical (planar) state, the substrate 105 is flattened in that the interior side 110 and the exterior side 115 are opposing and substantially parallel with respect to one another. At least one closure mechanism 120 holds the substrate 105 in the cylindrical state. The closure mechanism 120 includes a plurality of insertable portions 125 and a plurality of engageable portions 130. The closure mechanism 120 becomes engaged, holds the substrate 105 in the cylindrical state, upon insertion of the plurality of insertable portions 125 within the plurality of engageable portions 130. When engaged, the closure mechanism 120 mitigates withdrawal of the plurality of insertable portions 125 from the plurality of engageable portions 130.

As is shown in FIG. 1, the substrate 105 being in the concentric state forms a receptacle for a bottle or a can 135, and provides insulation to mitigate heat transfer of the bottle or can 135. The substrate 105, which can include at least one layer composed of neoprene, foam, polyester, cotton, or wool (or a combination thereof) will maintain the bottle or can 135 near its desired temperature (hot or cold). The closure mechanism 120 can be composed of at least one of plastic, metal, and rubber (or a combination thereof), or the closure mechanism 120 can be made of the same materials as the substrate 105.

Figure 2:
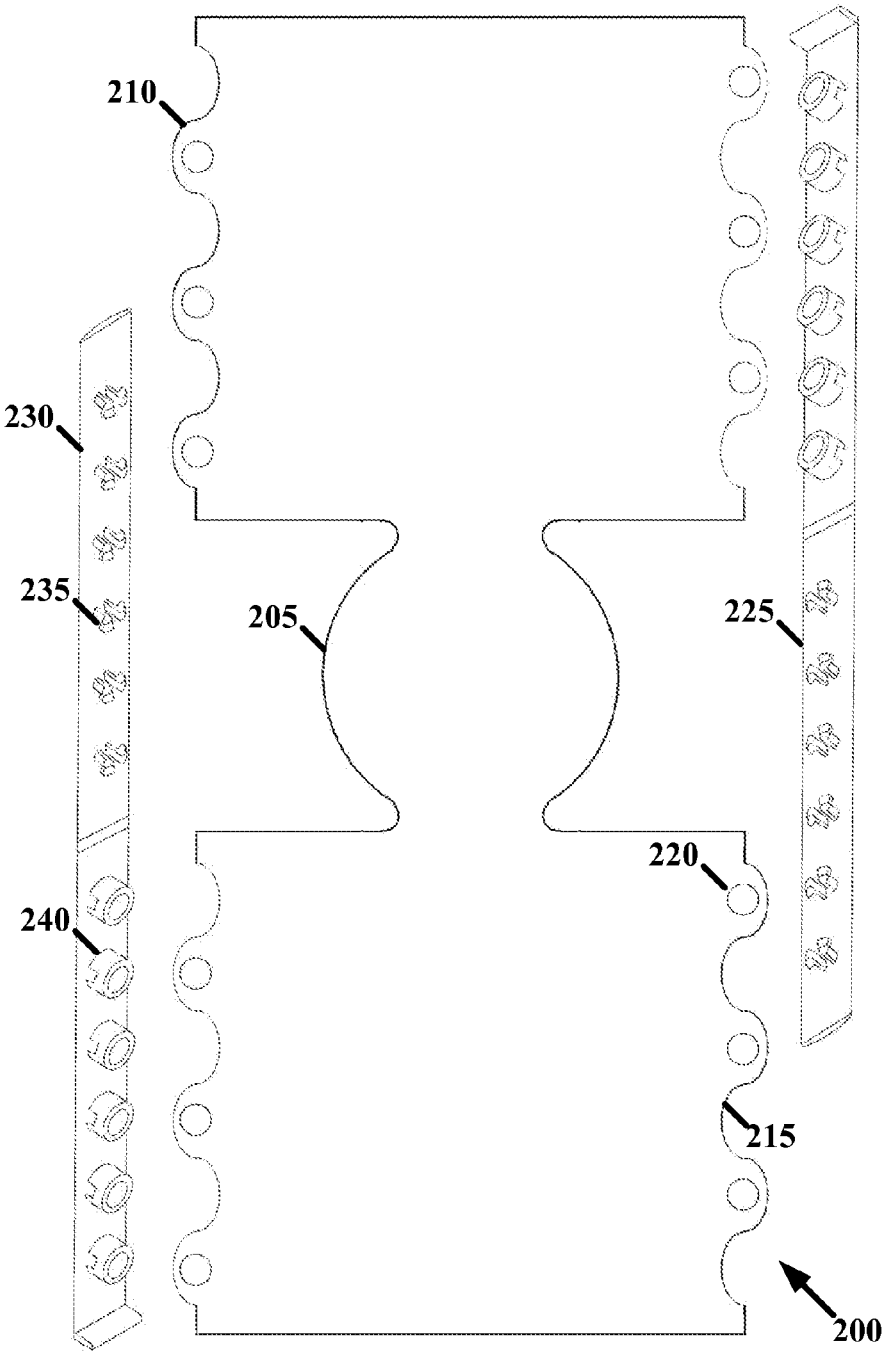
FIG. 2 shows a layout view of an example portable beverage apparatus, consistent with various aspects of the present disclosure.

FIG. 2 shows a layout view of an example portable beverage apparatus, consistent with various aspects of the present disclosure. A substrate 200 of the example portable beverage apparatus is shown in its planar state. In the planar state, the substrate 200 is flattened and the two sides of the substrate 200 are opposing and substantially parallel with respect to one another. The substrate 200 is shown in three separate portions: a base portion 205, an upper portion 210, and a lower portion 215. Each of the upper portion 210 and the lower portion 215 include a plurality of openings 220. In addition to the substrate 200, FIG. 2 also shows a first closure mechanism 225 and a second closure mechanism 230. The first closure mechanism 225 and the second closure mechanism 230 are integrated with the substrate 200 through the plurality of openings 220 to flex the substrate 200 into a cylindrical shape, as shown, for example, in FIG. 1. The first closure mechanism 225 and the second closure mechanism 230 include a plurality of insertable portions 235 and a plurality of engageable portions 240. To flex the substrate 200 into a cylindrical shape, the plurality of insertable portions 235 and the plurality of engageable portions 240 are integrated through the plurality of openings 220. The plurality of insertable portions 235 insert into the plurality of engageable portions 240, and mitigate withdrawal of the plurality of insertable portions 235 from the plurality of engageable portions 240, which will hold the substrate 200 in a cylindrical shape, as shown, for example, in FIG. 1.

In transitioning from the planar state, as shown in FIG. 2, to the cylindrical state as shown in FIG. 1, the upper portion 210 and the lower portion 215 are folded together, and the first closure mechanism 225 and the second closure mechanism 230 clamp together through the plurality of openings 220. In the cylindrical state, as shown in FIG. 1, the base portion 205 provides a bottom region that supports a beverage container inserted into the cylinder formed by the substrate 200.

Figure 3:
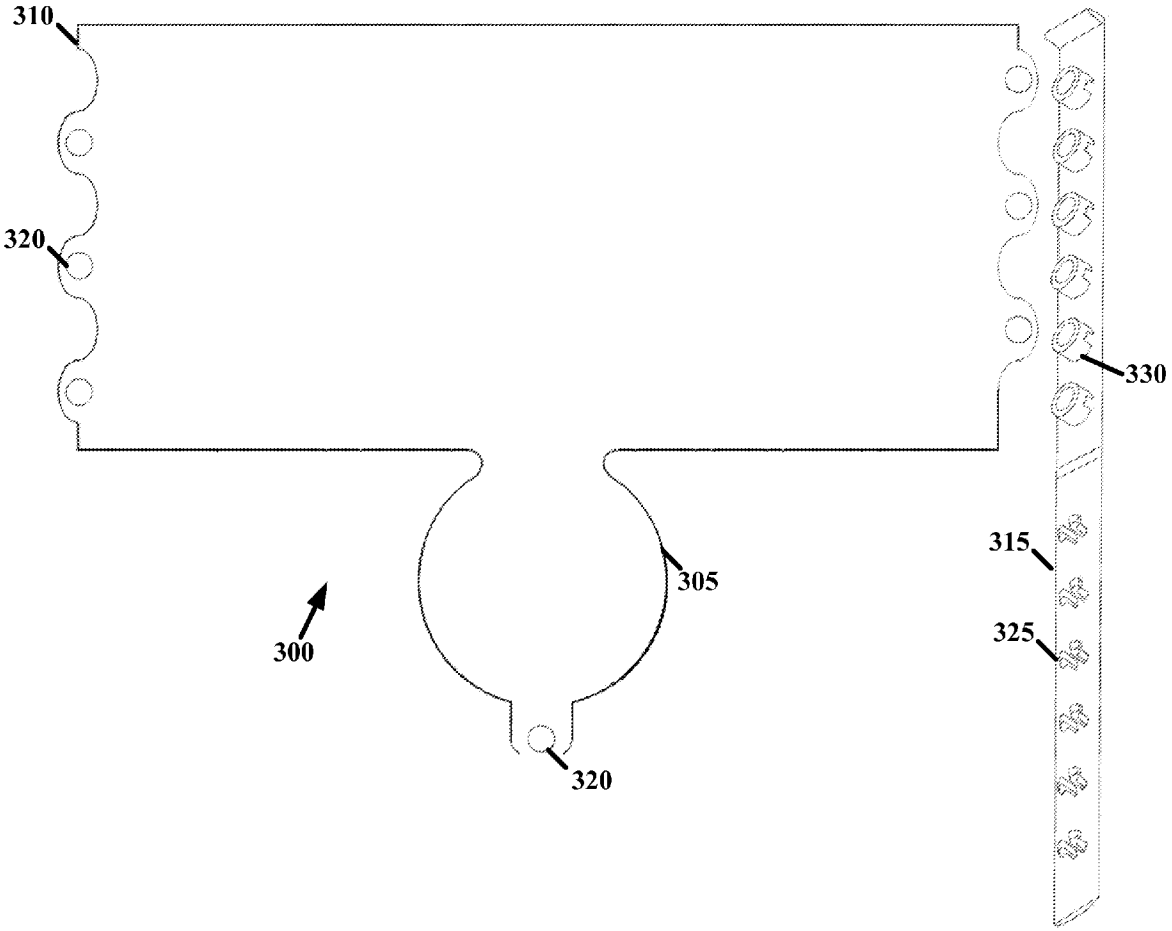
FIG. 3 shows a layout view of another example portable beverage apparatus, consistent with various aspects of the present disclosure.

FIG. 3 shows a layout view of another example portable beverage apparatus, consistent with various aspects of the present disclosure. A substrate 300 of the example portable beverage apparatus is shown in its planar state. The example portable beverage apparatus shown in FIG. 3 includes a base portion 305 and an upper portion 310. FIG. 3 also shows a closure mechanism 315 that integrates with the substrate 300 through a plurality of openings 320 in the base portion 305 and the upper portion 310 to flex the substrate 300 into a cylindrical shape, as shown, for example, in FIG. 1. The closure mechanism 315 includes a plurality of insertable portions 325 that insert into a plurality of engageable portions 330.

In order to form the example portable beverage apparatus shown in FIG. 3 into a cylindrical shape, the upper portion 310 of the substrate 300 is wrapped into a cylindrical shape, and the base portion 305 is folded under the cylindrical shape formed by the upper portion 310 of the substrate 300. The plurality of insertable portions 325 insert into the plurality of engageable portions 330 through the openings 320 in the base portion 305 and the upper portion 310 of the substrate 300. Once engaged, the closure mechanism 315 mitigates withdrawal of the plurality of insertable portions 330 from the plurality of engageable portions 335, which will hold the substrate 300 in a cylindrical shape, as shown, for example, in FIG. 1.

Figure 4:
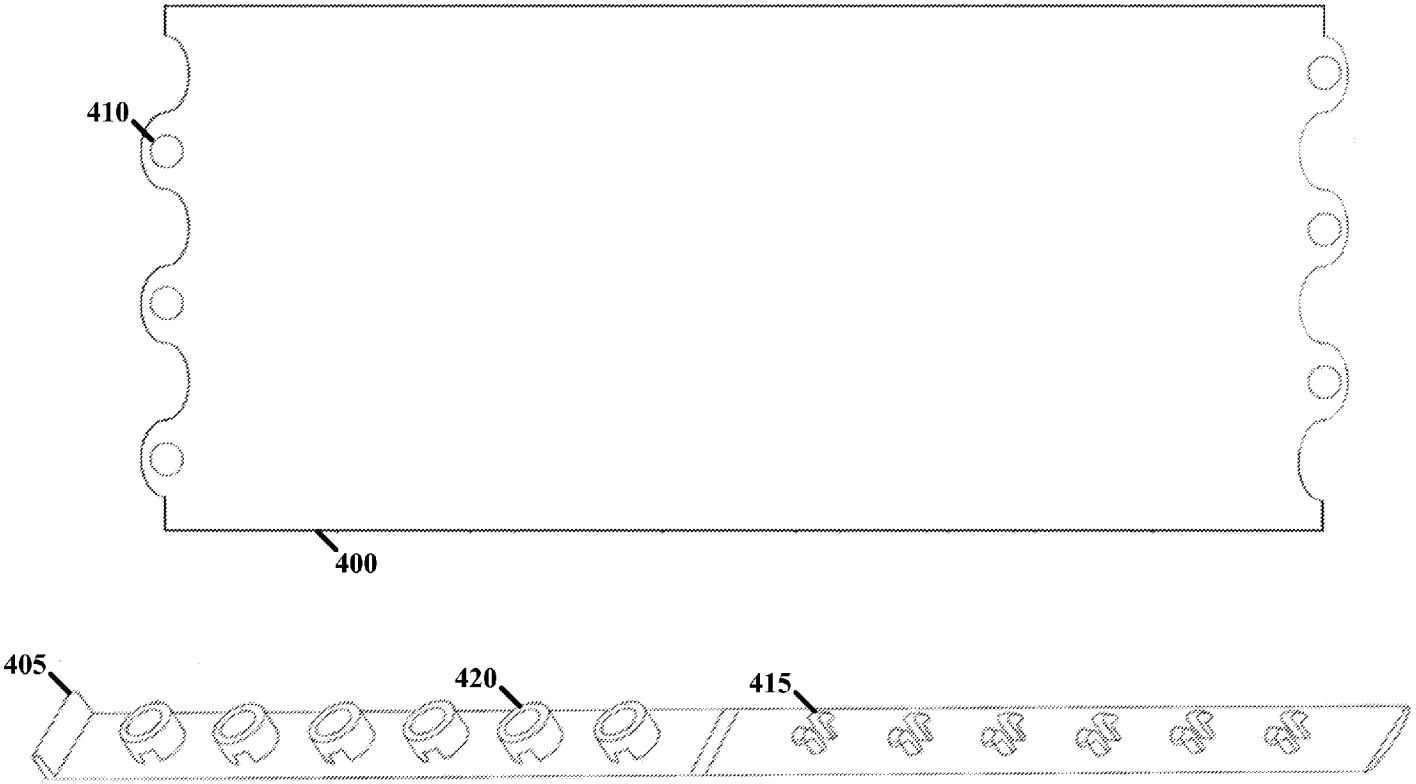
FIG. 4 shows a layout view of yet another example portable beverage apparatus, consistent with various aspects of the present disclosure.

FIG. 4 shows a layout view of yet another example portable beverage apparatus, consistent with various aspects of the present disclosure. A substrate 400 of the example portable beverage apparatus is shown in its planar state. FIG. 4 also shows a closure mechanism 405 that integrates with the substrate 400 through a plurality of openings 410 in the substrate 400. The closure mechanism 405 includes a plurality of insertable portions 415 that insert into a plurality of engageable portions 420. In order to flex the example portable beverage apparatus shown in FIG. 4 into a cylindrical shape, the substrate 400 is wrapped into a cylindrical shape, and the plurality of insertable portions 415 are inserted into the plurality of engageable portions 420 through the openings 410 in the substrate 400. Once engaged, the closure mechanism 405 mitigates withdrawal of the plurality of insertable portions 415 from the plurality of engageable portions 420, which will hold the substrate 400 in a cylindrical shape, as shown, for example, in FIG. 1.

In each of the above noted example portable beverage apparatuses, die cutting, laser cutting, or plotter cutting can be used to create the pattern designs of the substrate layer.

Figure 5A:
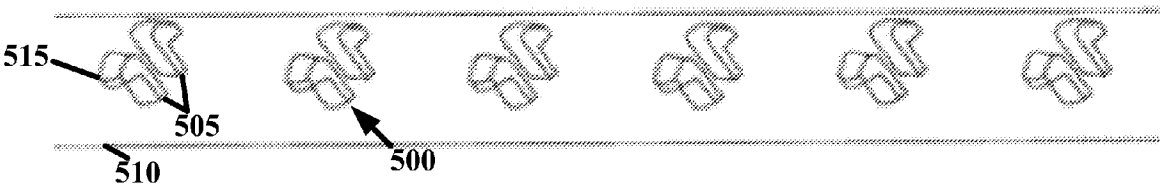
FIG. 5A shows example insertable portions of a closure mechanism, consistent with various aspects of the present disclosure.

FIG. 5A shows example insertable portions of a closure mechanism, consistent with various aspects of the present disclosure. A plurality of insertable portions 500 include two extension members 505 that extend perpendicularly from a base portion 510 of the closure mechanism. Additionally, each of the two extension members 505 includes at least one barb 515 that extend away from the extension members.

Figure 5B:
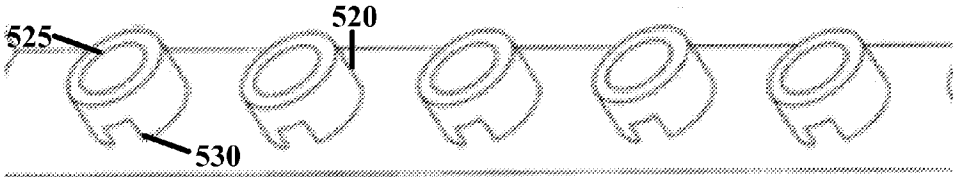
FIG. 5B shows example engageable portions of a closure mechanism, consistent with various aspects of the present disclosure.

FIG. 5B shows example engageable portions of a closure mechanism, consistent with various aspects of the present disclosure. A plurality of engageable portions 520 of the closure mechanism are cylindrical and include a first end portion 525 that facilitates insertion of the plurality insertable portions 500 (shown in FIG. 5A). The engageable portions 520 also include a locking portion 530 that engages the at least one barb 515 of the insertable portions 500 (shown in FIG. 5A) to prevent withdrawal the insertable portions 500 from the plurality of engageable portions 520.

Figure 6:
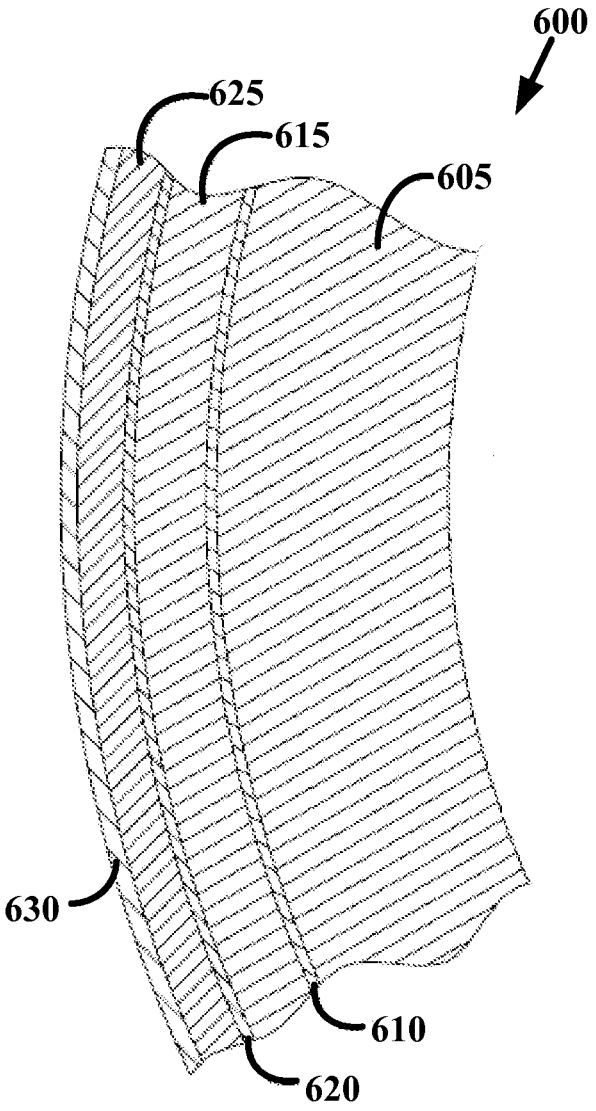
FIG. 6 shows example substrate layering, consistent with various aspects of the present disclosure.

FIG. 6 shows an example substrate layering, consistent with various aspects of the present disclosure. An example substrate 600 is shown that includes a plurality of different layers. An insulating layer 605 is provided as a base layer of the substrate 600. The insulating layer 605 can be composed of a material such as neoprene, foam, polyester, cotton, wool, or a combination thereof, such that the insulating layer 605 will mitigate heat transfer from an object that is surrounded by or contacting the insulating layer 605. The example substrate 600 also includes an adhesive layer 610 on the insulating layer 605. Surprisingly, the adhesive layer 610, can be composed of a pressure sensitive adhesive (PSA) and/or a thermal activated adhesive (e.g., vinyl ethers, butyl rubber, ethylene-vinyl acetate (EVA), natural rubber, nitriles, silicone rubbers, styrene block copolymers) can adhere to the insulating layer 605 and additionally provide a base for a metallization layer 615 (e.g., applied by roll-to-roll material vacuum metalizing). An optically clear adhesive 620 is layered on the metallization layer 615, and a print layer 625 is provided on the optically clear adhesive 620. The print layer 625 is layered in peaks and valleys such that the graphics provided by the print layer 625 appear textured, and can be provided in black or color ink. The print layer 625 is printed by silk screening, litho-printing, flexo-printing, die sublimation transfer or digital printing, and can include an ink composition of UV inks, oxidizing inks/paints or toner inks.

The combined layering of the substrate 600 provides an enhanced visual effect to the print layer 625. The metallization layer 615 acts as a reflector of light, which passes through transparent segments of the print layer 625. The varying degrees of thicknesses of the print layer 625 provide three-dimensional graphics visualization. Additionally, the substrate 600 includes a clear and flexible plastic layer 630 on the print layer 625 such that the exterior surface of the substrate 600 is planar, and thus, is not textured due to the print layer 625.

Based upon the above discussion and illustrations, those skilled in the art will readily recognize that various modifications and changes may be made without strictly following the exemplary embodiments and applications illustrated and described herein. Furthermore, various features of the different embodiments may be implemented in various combinations. Such modifications do not depart from the true spirit and scope of the present disclosure, including those set forth in the following claims.

What is claimed is:

1. An apparatus comprising:

a substrate including an interior side and an exterior side, the exterior side having an adhesive layer, a metallization layer provided on the adhesive layer, a printing layer of textured graphics arranged on the metallization layer, and a clear and flexible plastic layer configured and arranged to provide a planar surface over the printing layer, the substrate being configured and arranged to flex between a planar state, in which the interior side and the exterior side are opposing and substantially parallel with respect to one another, and a cylindrical state in which the interior side and the exterior side form concentric cylinders;

a first closure mechanism including a first set of a plurality of engageable portions and a plurality of insertable portions; and a second closure mechanism including a second set of a plurality of engageable portions and a plurality of insertable portions, the second closure mechanism being configured and arranged with the first closure mechanism to hold the substrate in the cylindrical state by insertion of the first set and second set of the plurality of insertable portions into the first set and the second set of the plurality of engageable portions, to engage the first closure mechanism and the second closure mechanism, and to mitigate withdrawal of the plurality of insertable portions from the plurality of engageable portions, the substrate being configured and arranged with the closure mechanisms to, in the cylindrical state, form a receptacle for an object, and to provide insulation to mitigate heat transfer of the object, with opposing ends of the substrate being interleaved along a linear direction and with the closure mechanisms engaging with the interleaved ends of the substrate along the linear direction.

2. The apparatus of claim 1, wherein the plurality of insertable portions of the first closure mechanism and the second closure mechanism each include two extension members extending perpendicularly from the substrate, and the two members include at least one barb extending away from the extension members; and the second plurality of engageable portions of the first closure mechanism and the second closure mechanism are cylindrical and include a first end portion configured and arranged to facilitate insertion of the plurality of insertable portions and a locking portion configured and arranged to engage the at least one barb, to prevent withdrawal of the plurality of insertable portions from the plurality of engageable portions.

3. The apparatus of claim 1, wherein, in the planar state, the substrate extends contiguously from a first end portion to a second end portion that are at laterally opposing ends of the substrate, and in the cylindrical state, the first end portion is arranged coupled to the second end portion to form the concentric cylinders.

4. The apparatus of claim 1, wherein the substrate, in the cylindrical state, includes the first closure mechanism arranged on a plane the same as that of the second closure mechanism.

5. The apparatus of claim 1, wherein the metallization layer is further configured and arranged to enhance a visual effect of the printing layer by acting as a reflector of light, which passes through transparent segments of the printing layer, and the printing layer includes varying degrees of thicknesses to provide three-dimensional graphics visualization.

6. The apparatus of claim 1, wherein the substrate includes at least one layer composed of at least one of the following materials: neoprene; foam; polyester; cotton; and wool.

7. The apparatus of claim 1, wherein the printing layer is provided at a thickness of up to 3 mm thick.

8. The apparatus of claim 1, wherein the first closure mechanism and the second closure mechanism each are composed of at least one of the following materials: plastic; metal; and rubber.

9. The apparatus of claim 1, wherein the substrate includes a plurality of openings, and the first closure mechanism and the second closure mechanism engage through the plurality of openings.

10. An apparatus comprising:

a substrate including an interior side and an exterior side, the substrate being configured and arranged to flex from a planar state, in which the interior side and the exterior side are opposing and substantially parallel with respect to one another, to a cylindrical state in which the interior side and the exterior side form concentric cylinders with opposing ends of the substrate being interleaved along a linear direction; and at least one closure mechanism including a plurality of engageable portions and a plurality of insertable portions, the at least one closure mechanism being configured and arranged to hold the substrate in the cylindrical state by insertion of the plurality of insertable portions into the plurality of engageable portions to engage the at least one closure mechanism with the interleaved portions of the substrate along the linear direction, and to mitigate withdrawal of the plurality of insertable portions from the plurality of engageable portions.

11. The apparatus of claim 10, wherein the plurality of insertable portions of the at least one closure mechanism includes two extension members extending perpendicularly from the substrate, and the two members include at least one barb extending away from the extension members; and the plurality of engageable portions of the at least one closure mechanism are cylindrical and include a first end portion configured and arranged to facilitate insertion of the plurality of insertable portions and a locking portion configured and arranged to engage the at least one barb to prevent withdrawal of the plurality of insertable portions from the plurality of engageable portions.

12. The apparatus of claim 10, wherein the substrate includes an adhesive layer, a metallization layer provided on the adhesive layer, a printing layer arranged on the metallization layer and configured to provide textured graphics, and a clear and flexible plastic layer configured and arranged to provide a planar surface over the printing layer.

13. The apparatus of claim 10, wherein the substrate includes at least one layer composed of at least one of the following materials: neoprene; foam; polyester; cotton; and wool.

14. The apparatus of claim 10, wherein the at least one closure mechanism is composed of at least one of the following materials: plastic; metal; and rubber.

15. The apparatus of claim 10, wherein the substrate includes a plurality of openings, and the plurality of insertable portions and the plurality of engageable portions engage through the plurality of openings, in the planar state, the substrate extends contiguously from a first end portion to a second end portion, the end portions being at laterally opposing ends of substrate, and in the cylindrical state, the first end portion is coupled to the second end portion to form the concentric cylinders.

16. A method comprising:

providing a substrate including an interior side and an exterior side, the exterior side having an adhesive layer, a metallization layer provided on the adhesive layer, a printing layer of textured graphics arranged on the metallization layer, and a clear and flexible plastic layer configured and arranged to provide a planar surface over the printing layer, the substrate being configured and arranged to flex from a planar state, in which the interior side and the exterior side are opposing and substantially parallel with respect to one another, to a cylindrical state in which the interior side and the exterior side form concentric cylinders and in which opposing ends of the substrate are interleaved along a linear direction;

providing a first closure mechanism including a first set of a plurality of engageable portions and a plurality of insertable portions;

providing a second closure mechanism including a second set of a plurality of engageable portions and a plurality of insertable portions; and inserting the first set and the second set of the plurality of insertable portions into the first set and the second set of the plurality of engageable portions to engage the first closure mechanism and the second closure mechanism with the substrate along the linear direction, to mitigate withdrawal of the plurality of insertable portions from the plurality of engageable portions and to hold the substrate in the cylindrical state.

17. The method of claim 16, wherein the step of providing a substrate includes printing on the printing layer by utilizing at least one of silk screening, litho-printing, flexo-printing, die sublimation transfer and digital printing.

18. The method of claim 16, wherein the step of providing a substrate includes performing at least one of die cutting, laser cutting, and plotter cutting.

19. The method of claim 16, wherein the step of providing a substrate includes printing the printing layer with an ink composition of at least one of UV inks, oxidizing inks/paints and toner inks.

* * * * *